US007740075B2

(12) United States Patent
Goughnour et al.

(10) Patent No.: US 7,740,075 B2
(45) Date of Patent: Jun. 22, 2010

(54) PRESSURE RELIEF ACTUATED VALVES

(75) Inventors: Paul G. Goughnour, Fresno, TX (US); Russell A. Johnston, Alvin, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 77 days.

(21) Appl. No.: 12/170,155

(22) Filed: Jul. 9, 2008

(65) Prior Publication Data

US 2010/0006295 A1 Jan. 14, 2010

(51) Int. Cl.
*E21B 34/10* (2006.01)

(52) U.S. Cl. ..... 166/375; 166/72; 166/73; 166/321; 166/334.1

(58) Field of Classification Search ..... 166/72, 166/73, 375, 321, 334.1
See application file for complete search history.

(56) References Cited

U.S. PATENT DOCUMENTS

| | | | | |
|---|---|---|---|---|
| 3,653,439 | A | 4/1972 | Kisling, III | |
| 4,161,219 | A | 7/1979 | Pringle | |
| 4,173,256 | A * | 11/1979 | Kilgore | 166/324 |
| 4,431,051 | A * | 2/1984 | Adams, Jr. | 166/72 |
| 4,658,904 | A | 4/1987 | Doremus et al. | |
| 4,660,646 | A | 4/1987 | Blizzard | |
| 6,433,991 | B1 | 8/2002 | Deaton et al. | |
| 6,523,613 | B2 | 2/2003 | Rayssiguier et al. | |
| 2006/0086509 | A1 | 4/2006 | McMillan et al. | |
| 2007/0137869 | A1 | 6/2007 | MacDougall et al. | |

FOREIGN PATENT DOCUMENTS

| | | | |
|---|---|---|---|
| GB | 1386257 | A | 3/1975 |
| GB | 1387752 | A | 3/1975 |
| GB | 1445603 | A | 8/1976 |
| GB | 14455602 | A | 8/1976 |
| GB | 1447993 | A | 9/1976 |
| GB | 1535357 | A | 12/1978 |
| WO | 0029715 | A1 | 5/2000 |
| WO | 0112950 | A1 | 2/2001 |

* cited by examiner

*Primary Examiner*—Giovanna C Wright
(74) *Attorney, Agent, or Firm*—Rodney V. Warfford; Brandon S. Clark; Winstead Sechrest & Minick

(57) ABSTRACT

An embodiment of a valve that is operable from one position to another position upon relief of an applied pressure includes a housing having a bore; a valve member disposed with the housing, wherein the valve member is actuated to one position in response to a certain applied pressure and actuates toward another position upon relief of the certain applied pressure; and a relief system relieving the pressure applied to the valve member when the applied pressure falls below a selected pressure level.

19 Claims, 4 Drawing Sheets

PRESSURE RELIEF ACTUATED VALVES

TECHNICAL FIELD

The present invention relates in general to valves and more specifically to pressure actuated valves.

BACKGROUND

Various types of valves and valve installations utilize the application and release of applied pressure to actuate the valve between positions. Often the failsafe position for the valve is the operational position associated with the relief of the applied pressure. It is a desire to provide a system that can relieve pressure applied at the valve when the applied pressure has fallen below a selected pressure level to facilitate the positive and complete actuation of the valve.

SUMMARY

An embodiment of a valve that is operable from one position to another position upon relief of an applied pressure includes a housing having a bore; a valve member disposed with the housing, wherein the valve member is actuated to one position in response to a certain applied pressure and actuates toward another position upon relief of the certain applied pressure; and a relief system relieving the pressure applied to the valve member when the applied pressure falls below a selected pressure level.

An embodiment of a wellbore completion includes a tubular string disposed in the wellbore; a subsurface safety valve ("SSSV") connected within the tubular string and disposed in the wellbore; a pressurized fluid source in connection with the SSSV through a control line, wherein the selected pressure level is related to a determined change in the pressure from the certain applied pressure; and a pressure relief system in hydraulic communication with the control line, wherein the pressure relieve system relieves pressure applied to the SSSV through the control line when the applied pressure falls below a selected pressure level.

An embodiment of a method of ensuring positive closing of a subsurface safety valve ("SSSV") positioned in a wellbore includes the steps of supplying a hydraulic fluid through a control line to the SSSV; maintaining the SSSV in an open position by a applying a certain applied hydraulic pressure through the control line; actuating the SSSV to close by relieving the certain applied hydraulic pressure; and releasing hydraulic fluid from the control line when the hydraulic pressure falls below a selected pressure level.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
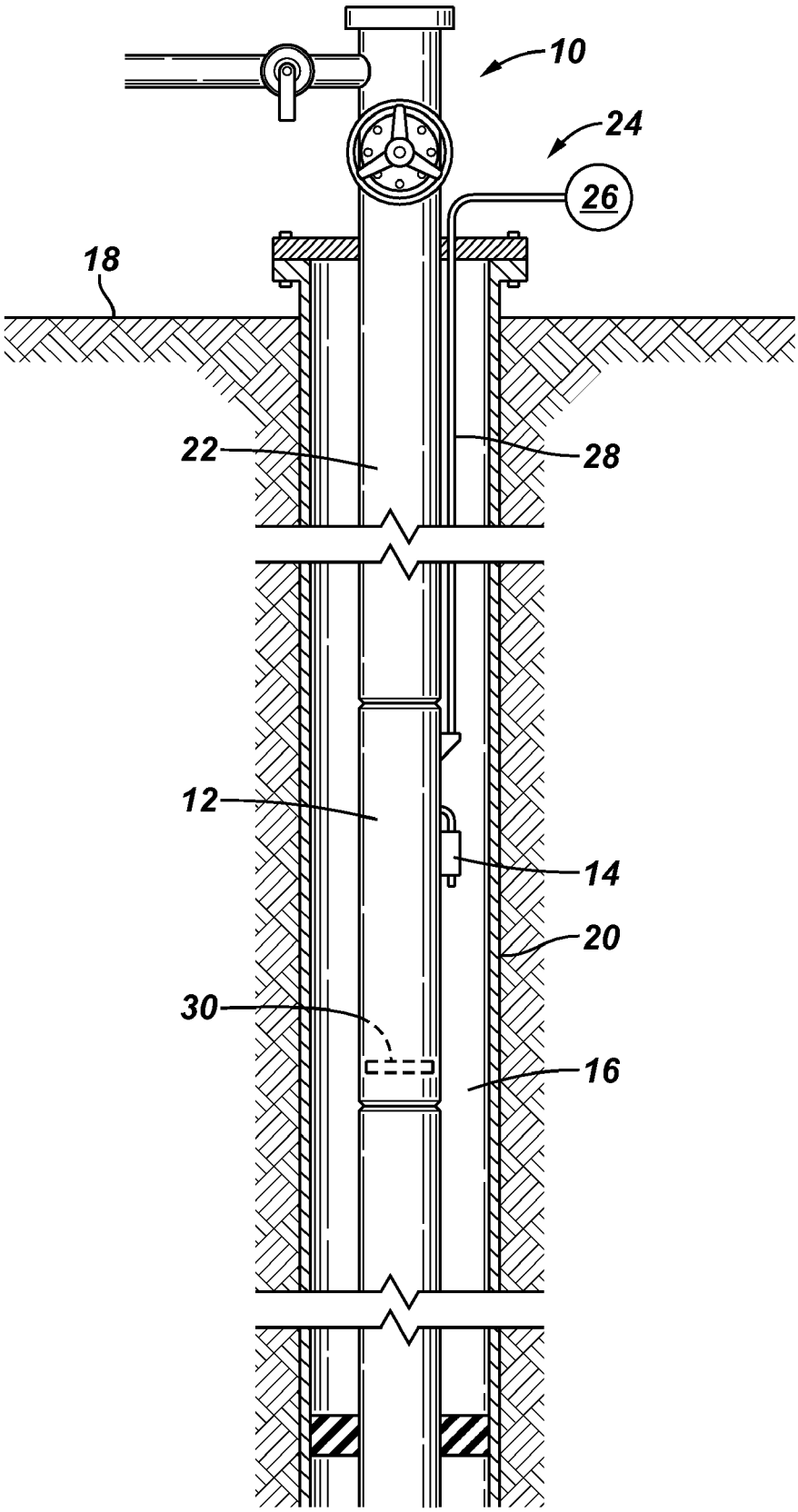
FIG. 1 is a schematic of an embodiment of a wellbore completion incorporating a subsurface safety valve with a pressure relief system.

Refer now to the drawings wherein depicted elements are not necessarily shown to scale and wherein like or similar elements are designated by the same reference numeral through the several views.

For purposes of description, the present invention will be described herein with reference to a subsurface safety valve. However, it should be readily recognized that the apparatus, systems, and methods described herein may be utilized with any valve or other device that is actuated from one position to another position by the release of an applied pressure.

It is common to use subsurface safety valves (SSSV) in wellbores to control fluid flow through a well conduit. The subsurface safety valves are commonly actuated to the open position by the application of hydraulic fluid from the surface and are biased to the closed position by a biasing mechanism, such as without limitation an enclosed pressurized fluid chamber or a mechanical spring. In some installations a pressurized fluid line may be provided for closing the valve. The hydraulic force may be applied to a piston and cylinder assembly that acts against the biasing force of the biasing mechanism to open and hold the safety valve opened. The biasing force acts on the piston to close the valve when the hydraulic pressure is reduced below a certain value. Examples of some subsurface safety valves are provided in U.S. Pat. Nos. 4,161,219 and 4,660,646, which are incorporated herein by reference.

Referring now to FIG. 1, a schematic of a production well 10 incorporating an embodiment of a subsurface safety valve 12 having a failsafe pressure relief system 14 is provided. In the illustrated embodiment well 10 includes a wellbore 16 extending from a surface 18 and lined with casing 20. A tubular string 22 is disposed in wellbore 16. Subsurface safety valve 12 is connected within tubular string 22. In this example, subsurface safety valve 12 is operated by a pressurized fluid, referred to herein as hydraulic fluid. Hydraulic system 24 may provide hydraulic pressure through a manifold 26 through a control line 28 to subsurface safety valve 12.

Hydraulic pressure is provided through control line 28 to subsurface safety valve 12 actuating valve member 30 to the open position allowing fluid to flow across subsurface safety valve 12 within tubular string 22. Hydraulic pressure is maintained above a certain level to hold valve member 30 in the open position. To actuate subsurface safety valve 12 to the closed position, as shown in FIG. 1, the hydraulic pressure via control line 28 is reduced below a certain level. As is known in the art, the hydraulic pressure is reduced below the level of the force that biases valve member 30 to the closed position. In some circumstances a pressure spike may occur in the hydraulic system during the process of closing valve member 30 resulting in the failure to obtain complete closure of subsurface safety valve 12 or in delaying the timely closure of subsurface safety valve 12. Pressure relief system 14 provides an alternative mechanism to relieve a pressure spike or excess pressure after a desired pressure has been relieved to ensure that subsurface safety valve 12 closes properly.

Figure 2:
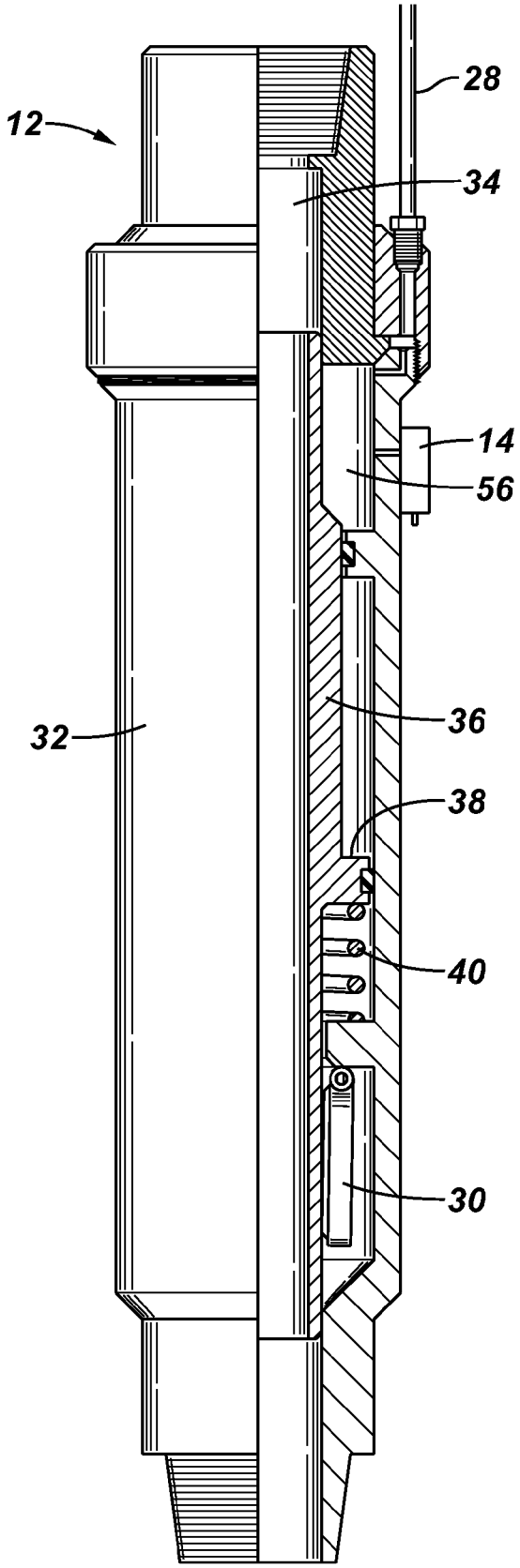
FIG. 2 is a partial cross-section of an embodiment of valve of the present invention.

Referring now to FIG. 2, a partial cross-section view of an embodiment of a valve 12 of the present invention is illustrated. In the illustrated embodiment valve 12 is a subsurface safety valve. Subsurface safety valve 12 includes a housing 32 having a longitudinal bore 34. Valve member 30 is a flapper in this embodiment. Flow tube 36 is movably disposed within housing 32. In this embodiment, the valve actuation assembly includes a piston 38 that is connected to flow tube 36. A biasing mechanism 40 biases flow tube 36 upward in FIGS. 1 and 2 allowing valve member 30 to move to the closed position. Biasing mechanism 40 is illustrated as a spring but may include alternatively or in combination other biasing mechanism such as and without limitation a pressurized fluid.

To open subsurface safety valve 12, as illustrated in FIG. 2, hydraulic pressure is applied through control line 28 to piston 38 providing a downward force on flow tube 36 that is greater than the counteracting force applied to flow tube 36 by biasing mechanism 40 thereby moving flow tube 36 and valve member 30 to the open position. SSSV 12 is maintained in the open by the maintenance of hydraulic pressure at piston 38.

To close subsurface safety valve 12, for example due to a pressure kick in the well, the hydraulic pressure is relieved from control line 28 to a level such that biasing mechanism 40 moves flow tube 36 permitting valve member 30 to close. Pressure relief system 14 is in operational connection with the hydraulic system and the valve actuation assembly such that when the hydraulic pressure is relieved in control line 28 to certain level, subsequent pressure above that level may be relieved through system 14 to provide for positive closing of subsurface safety valve. Pressure relief system 14 may be mechanically and/or hydraulically operated.

Figure 3:
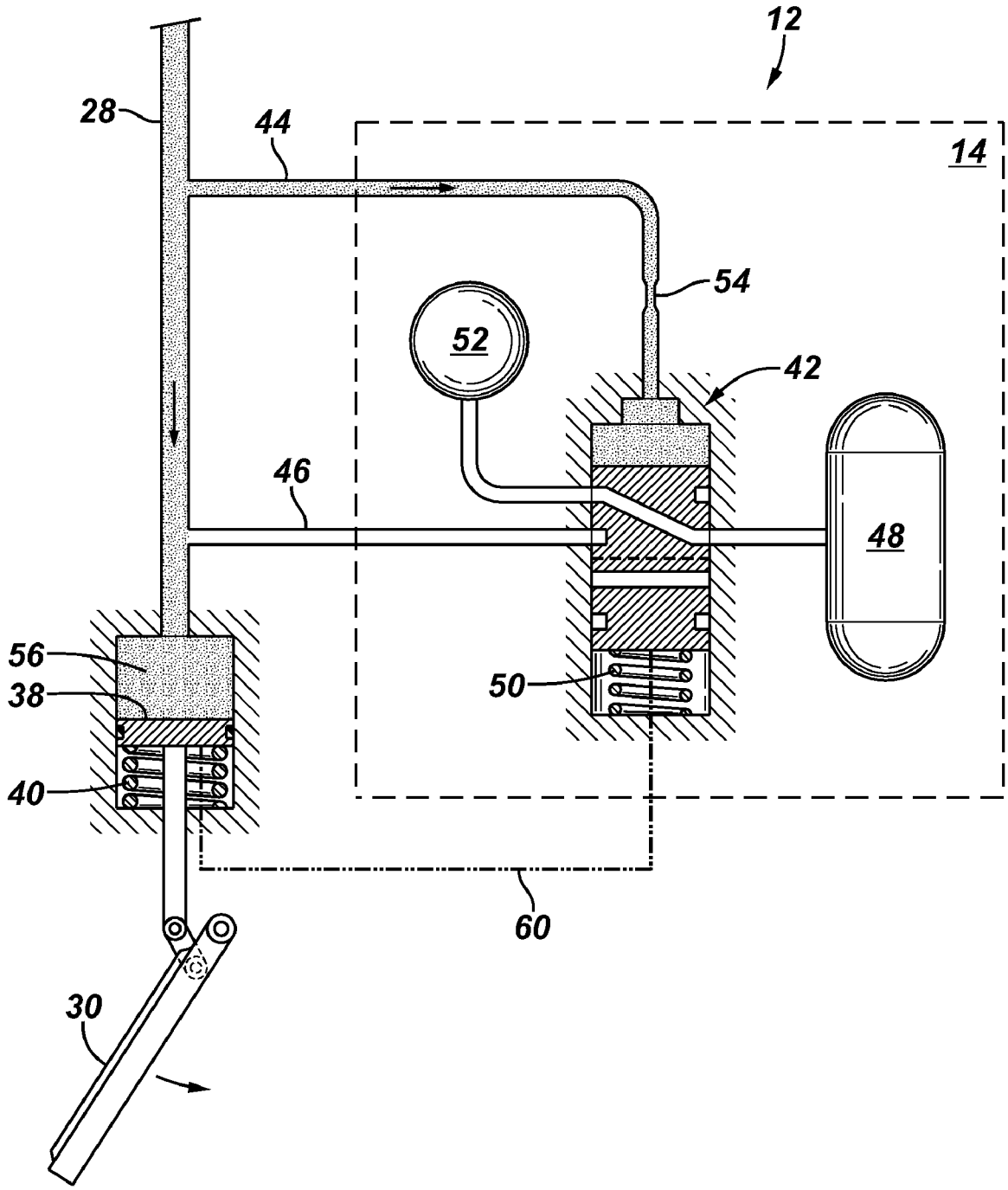
FIGS. 3 and 4 are pressure circuit diagrams of an embodiment of a valve of the present invention.

Refer now to FIG. 3, wherein a circuit diagram of an embodiment of the present invention is provided. Hydraulic control line 28 is operationally connected to piston 38. Pressure relief system 14 includes a relief valve 42. In the illustrated embodiment, relief valve 42 is a three-way valve. Relief valve 42 is operationally connected to control line 28 and piston 38. A valve control line 44 hydraulically connects control line 28 and valve 42. A relief line 46 is hydraulically connected to the control line 28 and an accumulator 48 via relief valve 42. Relief valve 42 may be biased toward a relief position (FIG. 4) hydraulically connecting accumulator 48 with the hydraulic pressure being exerted on piston 38, thereby establishing an alternative pressure relief passageway. In the illustrated embodiments, valve 42 is urged toward the relief position by a biasing mechanism 50, illustrated as a spring.

Referring to FIG. 3, safety valve 12 is shown in the open position or in the process of being opened. Control line 28 and is pressurized to a level such that the force provided by piston 38 actuates valve member 30 to the open position. The hydraulic pressure provided through control line 28 is communicated to relief valve 42, actuating relief valve 42 to the closed position as shown in FIG. 3.

Figure 4:
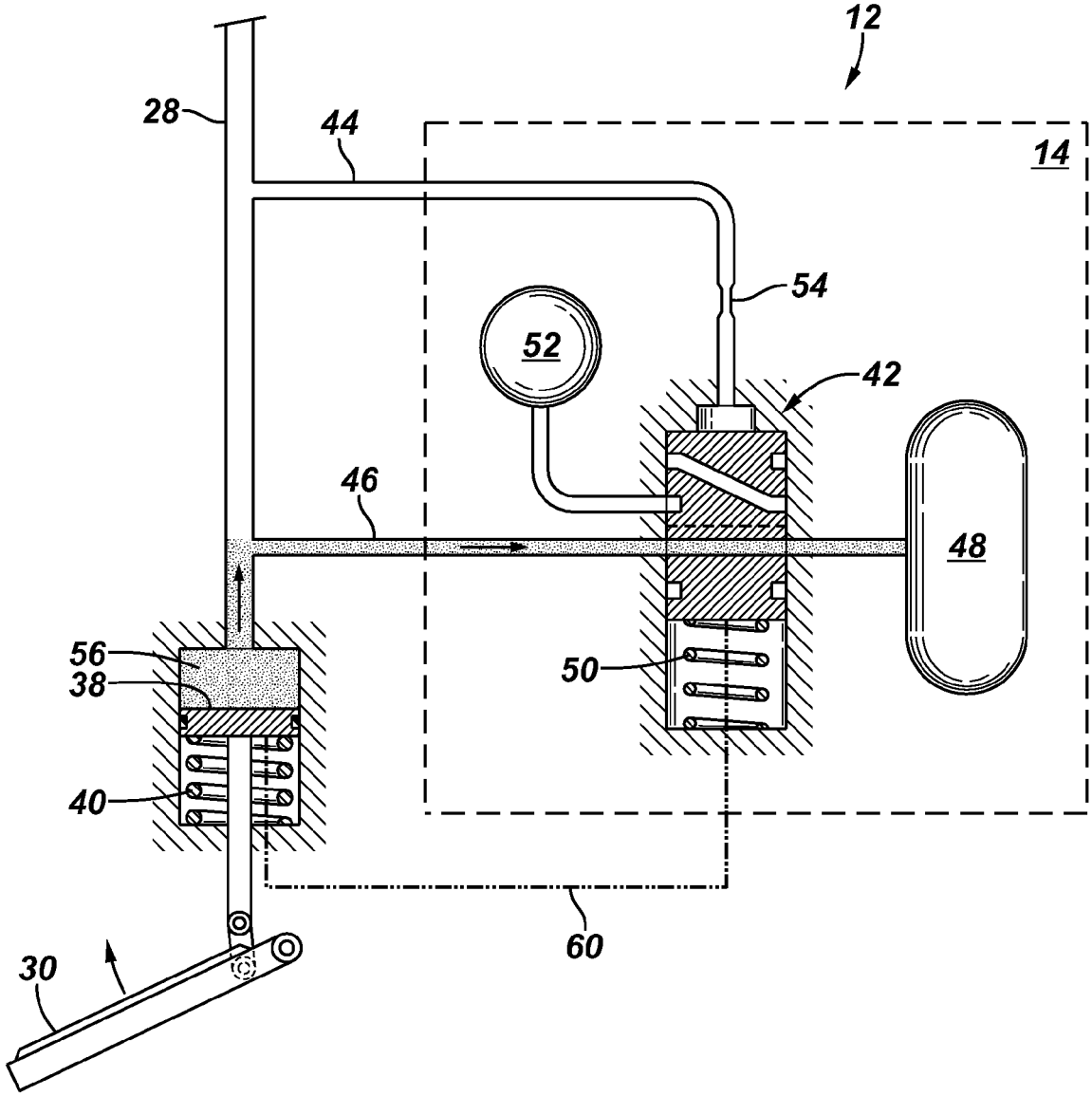

FIG. 4 illustrates safety valve 12 being operated from the open to the closed position. When hydraulic pressure is relieved to a certain level in control line 28, piston 38 and valve member 30 begin moving toward the closed position. When the hydraulic pressure in line 44 reaches a selected level, valve 42 is actuated to the relief or bypass position as illustrated in FIG. 4 allowing hydraulic fluid from cylinder 56 and/or at least a portion of control line 28 to flow into accumulator 48, thereby establishing an alternative pressure relief mechanism.

It is understood that the selected pressure for actuating relief valve 42 to the relief position may be a different pressure level from that allowing safety valve 12 to move from the open to the closed position. Various means and methods may be utilized for selecting the pressure levels for actuating the various valves including without limitation restrictors or chokes 54 and biasing mechanism 50. It is also understood that the pressure level selected for actuating relief valve 42 to the relief position may be related to the actuating pressure of valve member 30. For example, it may be desired to actuate relief valve 42 to the relief position after a desired pressure drop at piston 38 has occurred. In this manner relief valve 42 may facilitate relieving any pressure spikes or the like that occur within the hydraulic system during the closing of safety valve 12 to ensure that a positive closing of safety valve 12 occurs. A pressure spike as used herein includes increases in pressure or stagnation of pressure at a level preventing proper closing of safety valve 12. For example, an obstruction or failure of an element within the hydraulic system that prevents the evacuation or release of hydraulic fluid from control line 28 may prevent full closure of valve member 30. Pressure relief 14 also facilitates a quicker release of hydraulic pressure on piston 38 for closing a valve member 30.

Pressure release system 14 may be positioned within housing 32 (FIG. 2) and/or positioned exterior of housing 32. In some embodiments, accumulator 48 may be a chamber positioned for example whithin housing 32. In other embodiments, accumulator 48 may be wellbore 16 wherein the relieved hydraulic fluid is exhausted directly into wellbore 16.

In the embodiment illustrated in FIGS. 3 and 4, accumulator 48 is a chamber or reservoir separate and apart from wellbore 16. In the illustrated embodiment relief valve 42 provides for exhausting accumulator 48 when relief valve 42 is in the closed position. For example, when relief valve 42 is in the closed position communication is provided through valve 42 between accumulator 48 and exhaust 52. In this example, exhaust 52 may be wellbore 16. The step of evacuating accumulator 48 facilitates re-opening of safety valve 12 after a valve closing and pressure relief process while maintaining the pressure relief functionality.

In an alternative embodiment also illustrated in FIGS. 3 and 4, the pressure relief valve 42 may be actuated either directly or indirectly by the position of the piston 38, such as through some form of optional linkage 60 (represented by a double dashed line coupling piston 38 to pressure relief valve 42). In such a case, the linkage 60 may interact with the pressure relief valve 42 either alternatively or in addition to the hydraulic pressure present in line 44. In other cases, the pressure relief valve 42 may be integrated with the piston 38. In some embodiments, when the hydraulic pressure applied to the piston 38 falls below a selected pressure level, the piston 3 8 may begin to move, resulting in the actuation of the pressure relief valve 42.

From the foregoing detailed description of specific embodiments of the invention, it should be apparent that a system to facilitate the actuation of a valve member in response to pressure relief that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A valve configured to move between a first and second position in response to applied pressure, the valve comprising:

a housing having a bore;

a valve member disposed with the housing, wherein the valve member is actuated to the first position in response to a certain applied pressure and is actuated to the second position upon relief of the certain applied pressure; and a pressure relief system establishing an alternative pressure relief passageway for the applied pressure when the applied pressure falls below a selected pressure level, wherein the valve member is operably coupled to the pressure relief system via a mechanical linkage.

2. The valve of claim 1, wherein the certain applied pressure and the selected pressure level are substantially the same.

3. The valve of claim 1, wherein the selected pressure level is less than the certain applied pressure level.

4. The valve of claim 1, wherein the applied pressure is a pressurized fluid.

5. The valve of claim 1, further including a piston in connection with the valve member, wherein the applied pressure is applied to the piston actuating the valve member.

6. The valve of claim 1, wherein the selected pressure level is directly or indirectly related to a determined change in the applied pressure from the certain applied pressure.

7. The valve of claim 1, wherein the relief system comprises a bypass valve that opens when the applied pressure is at or below the selected pressure level.

8. The valve of claim 1, wherein the relief system comprises:

an accumulator; and a bypass valve, the bypass valve providing pressure communication to the accumulator when the applied pressure falls below the selected pressure level.

9. The valve of claim 8, wherein the selected pressure level is related to a determined change in the pressure from the certain applied pressure.

10. The valve of claim 1, wherein the pressure relief system is disposed exterior of the housing.

11. The valve of claim 10, wherein the relief system comprises a bypass valve that opens when the applied pressure is at or below the selected pressure level.

12. The valve of claim 10, wherein the relief system comprises:

an accumulator; and a bypass valve, the bypass valve providing pressure communication to the accumulator when the applied pressure falls below the selected pressure level.

13. The valve of claim 1, wherein the pressure relief system is operated based upon a position of the valve member.

14. A wellbore completion comprising:

a tubular string disposed in the wellbore;

a subsurface safety valve ("SSSV") connected within the tubular string wherein the SSSV is configured to open in response to a certain applied pressure;

a pressurized fluid source in connection with the SSSV through a control line, wherein a selected pressure level is related to a determined change in pressure from the certain applied pressure;

a pressure relief system in fluid communication with the control line, wherein the pressure relief system provides an alternative pressure relief mechanism for pressure applied to the SSSV through the control line when the pressure falls below the selected pressure level; and a mechanical linkage operably coupling a valve member of the SSSV to the pressure relief system.

15. The wellbore completion of claim 14, wherein the selected pressure level is related to a determined change in the pressure below the certain applied pressure.

16. The wellbore completion of claim 14, wherein the pressure relief system comprises a bypass valve providing selective fluid communication from the control line to an accumulator.

17. A method of ensuring positive closing of a subsurface safety valve ("SSSV") positioned in a wellbore, the method comprising the steps of:

supplying a hydraulic fluid through a control line to the SSSV;

maintaining a valve member of the SSSV in an open position by a applying a certain applied hydraulic pressure through the control line;

actuating the SSSV to close by relieving the certain applied hydraulic pressure; and releasing hydraulic fluid from the SSSV via an alternative pressure relief mechanism when the hydraulic pressure falls below a selected hydraulic pressure level, wherein the valve member is operably coupled to the pressure relief system via a mechanical linkage.

18. The method of claim 17, wherein the selected hydraulic pressure level is a determined change from the certain applied hydraulic pressure.

19. The method of claim 17, wherein the step of releasing the hydraulic fluid comprises opening a fluid path to an accumulator.

* * * * *